US008292576B2

(12) United States Patent
Frost et al.

(10) Patent No.: US 8,292,576 B2
(45) Date of Patent: Oct. 23, 2012

(54) COMPRESSOR SCROLLS FOR AUXILIARY POWER UNITS

(75) Inventors: Cristopher Frost, Scottsdale, AZ (US); Bruce Dan Bouldin, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 1415 days.

(21) Appl. No.: 12/059,684

(22) Filed: Mar. 31, 2008

(65) Prior Publication Data

US 2009/0246009 A1 Oct. 1, 2009

(51) Int. Cl.
*F01D 25/24* (2006.01)

(52) U.S. Cl. ..... 415/204; 415/206; 415/211.2; 415/212.1

(58) Field of Classification Search ..... 415/204, 415/211.2, 212.1, 224.5
See application file for complete search history.

(56) References Cited

U.S. PATENT DOCUMENTS

| | | | | |
|---|---|---|---|---|
| 2,628,767 | A * | 2/1953 | Wosika | 415/204 |
| 2,631,427 | A * | 3/1953 | Rainbow | 60/792 |
| 2,648,491 | A * | 8/1953 | Wood | 417/381 |
| 2,651,913 | A * | 9/1953 | Hodgson | 60/758 |
| 5,235,803 | A * | 8/1993 | Rodgers | 60/785 |
| 6,968,697 | B2 | 11/2005 | Nguyen et al. | |
| 7,093,448 | B2 | 8/2006 | Nguyen et al. | |
| 7,097,411 | B2 | 8/2006 | Smoke et al. | |

FOREIGN PATENT DOCUMENTS

WO 2006018591 A1 2/2006

* cited by examiner

*Primary Examiner* — Ninh H Nguyen
(74) *Attorney, Agent, or Firm* — Ingrassia Fisher & Lorenz, P.C.

(57) ABSTRACT

A compressor scroll is provided for redirecting an airflow from a compressor. The compressor scroll includes a spiral-shaped body; a radial inlet formed in the body for receiving the airflow from the compressor as inlet airflow; and an outlet formed in the body such that inlet airflow flows through the body and exits the outlet as outlet airflow, with at least a portion of the outlet airflow crossing at least a portion of the inlet airflow.

17 Claims, 4 Drawing Sheets

COMPRESSOR SCROLLS FOR AUXILIARY POWER UNITS

TECHNICAL FIELD

The present invention generally relates to auxiliary power units for aircraft, and more particularly relates to compressor scrolls used in auxiliary power units for aircraft.

BACKGROUND

In many aviation applications, it is necessary to provide compressed air from the aircraft engines to the aircraft. The aircraft may utilize an auxiliary power unit (APU) to provide compressed air, both when the aircraft is on the ground and when it is in flight. Air can be taken from the APU to pressurize or to otherwise condition the cabin air, or for example, to cool avionics equipment or start the main engines on the ground or in-flight. In these aviation applications, there is a constant desire to improve performance and to decrease the size and weight.

A radial or centrifugal compressor can be used in the APU to compress air. In these cases, the compressor scroll is used to direct the compressed air from the centrifugal compressor and deliver it to aircraft ducting, which then carries it to various aircraft systems, such as the environmental control system (ECS) or the main engine starters. The compressor scroll is typically spiral-shaped with a radial opening that transitions through a body to an outlet. A number of considerations must be contemplated when designing the compressor scroll. Primarily, aerodynamic considerations must be weighed with sizing considerations. Typically, the compressor scroll should be able to redirect the compressed air from the inlet to the outlet while maintaining the quantity and uniformity of the velocity and pressure of the compressed air, as well as minimizing pressure drop. At the same time, it is advantageous to make the compressor scroll as compact as possible such that the overall size and weight of the APU can be minimized. Many conventional compressor scrolls require elongated or straight portions to prevent pressure loss and maintain the velocity, particularly at the outlet of the compressor scroll. However, these arrangements may compromise the size of the compressor scroll, and as a result, the overall size of the APU.

Accordingly, it is desirable to provide a more compact compressor scroll. In addition, it is desirable to provide a compressor scroll that maximizes performance while minimizing the size and weight of the compressor scroll. Furthermore, other desirable features and characteristics of the present invention will become apparent from the subsequent detailed description of the invention and the appended claims, taken in conjunction with the accompanying drawings and this background of the invention.

BRIEF SUMMARY

In one exemplary embodiment, a compressor scroll is provided for redirecting an airflow from a compressor. The compressor scroll includes a spiral-shaped body; a radial inlet formed in the body for receiving the airflow from the compressor as inlet airflow; and an outlet formed in the body such that inlet airflow flows through the body and exits the outlet as outlet airflow, with at least a portion of the outlet airflow crossing at least a portion of the inlet airflow.

In accordance with another exemplary embodiment, an auxiliary power unit for an aircraft is provided. The auxiliary power unit includes a compressor for receiving and compressing air; and a compressor scroll for receiving the air from the compressor and redirecting the air into a duct for supplying the air to other portions of the aircraft. The compressor scroll includes an inlet coupled to the compressor and receiving the air as inlet airflow; an outlet configured to be coupled to, and providing the air to, the duct as outlet airflow; and a spiral-shaped body extending from the inlet to the outlet such that at least a portion of the outlet airflow crosses the inlet airflow.

In accordance with yet another exemplary embodiment, a compressor scroll is provided for redirecting an airflow from a compressor. The compressor scroll includes a spiral-shaped body that spirals in a first plane; a radial inlet formed in the body for receiving the airflow from the compressor as inlet airflow, the inlet having a radial extent; and an outlet formed in the body such that inlet airflow flows through the body and exits the outlet as outlet airflow. The outlet extends at least partially out of the first plane within the radial extent of the inlet such that at least a portion of the outlet airflow crosses at least a portion of the inlet airflow. The outlet has a diameter and a radius of curvature, with the radius of curvature being less than about 1.5 times the diameter.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments described herein provide an auxiliary power unit having a compressor scroll that improves or maintains aerodynamic performance relative to conventional compressor scrolls while achieving a more compact design. More specifically, exemplary embodiments can include compressor scrolls in which the outlet airflow crosses over the inlet airflow. In other words, at least a portion of the radial inlet overlaps the outlet.

Figure 1:
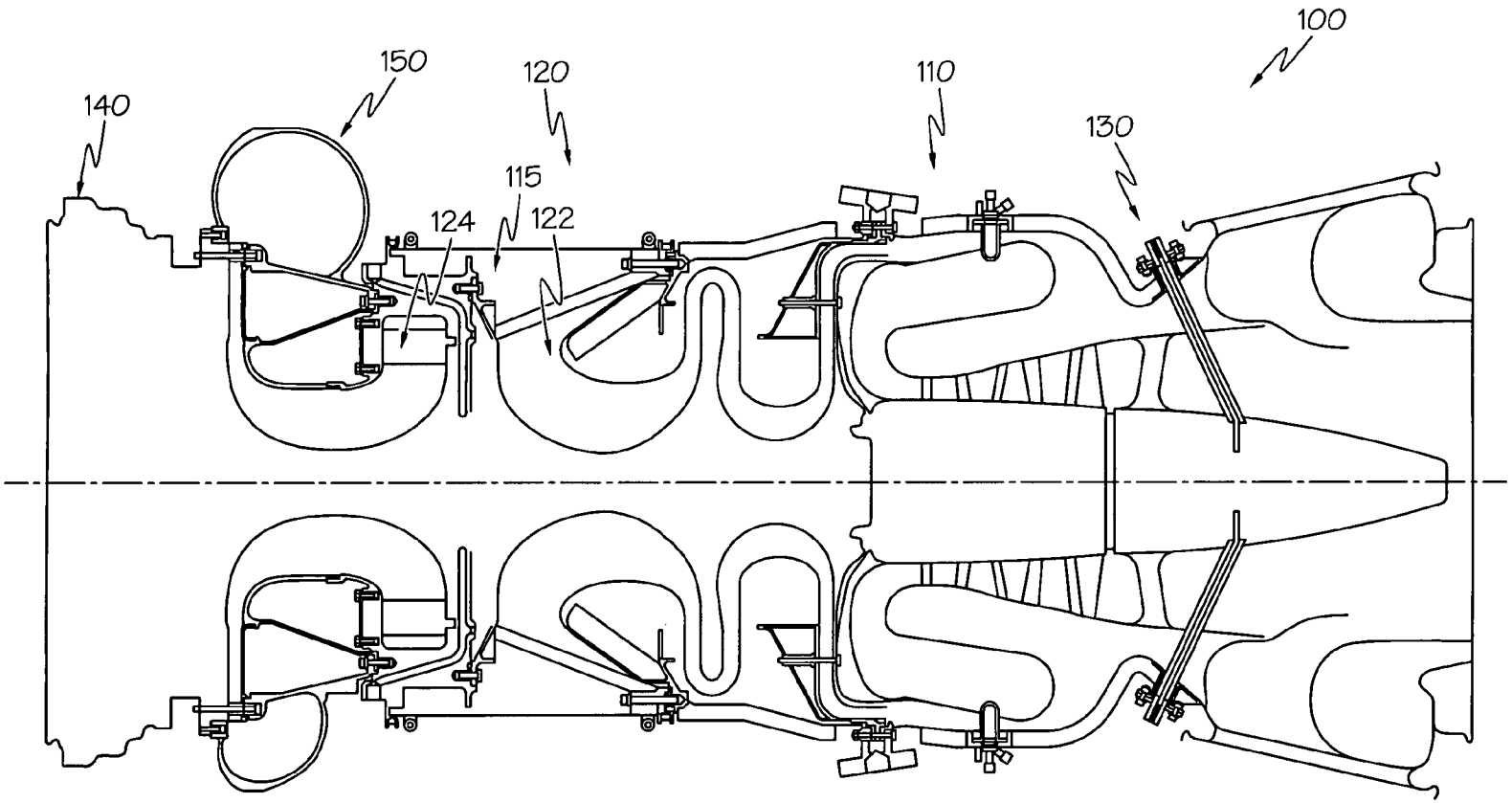
FIG. 1 is a cross-sectional, side view of an auxiliary power unit in accordance with an exemplary embodiment.

FIG. 1 shows a turbine engine, which in this example is an auxiliary power unit (APU) 100 for providing auxiliary power and air to the aircraft. Broadly, the APU 100 may include a combustion module 110, a compressor module 120, and a turbine module 130. The APU 100 can be especially useful in high-performance jet aircraft, and will be discussed in the context of such; however, the APU 100 can also be used in other types of aircraft, as well as spacecraft, missiles and other vehicles.

Airflow typically enters the APU 100 at an inlet 115 of the compressor module 120. A first portion of the airflow flows through a two-stage engine compressor 122, which is coupled to the combustion module 110. The compressed air is received by the combustion module 110, mixed with fuel, and ignited to produce combustion gases. The turbine module 130 is coupled to combustor module 110, and receives and extracts energy from the combustion gases. The turbine module 130 is connected via a shaft to the compressor module 120 and a gearbox module 140. Generators attached to the gearbox module 140 can be used to generate electricity to power portions of the aircraft.

A second portion of the airflow entering the APU 100 at the inlet 115 flows into a compressor 124. The compressor 124 is powered by the turbine module 130 via a shaft. The compressor 124 can be a radial or centrifugal compressor wheel with rotating impeller blades that pressurize and accelerate the airflow. A compressor scroll 150 is circumferentially mounted on the compressor 124. The compressor scroll 150 receives the compressed air from the compressor 124 and redirects it into a duct such that it can be provided to other portions of the aircraft, for example, to cool avionics equipment and/or to pressurize and cool the aircraft cabin or to start the main engines. The compressor scroll 150 will be described in further detail below with reference to FIGS. 2 and 3.

Figure 2:
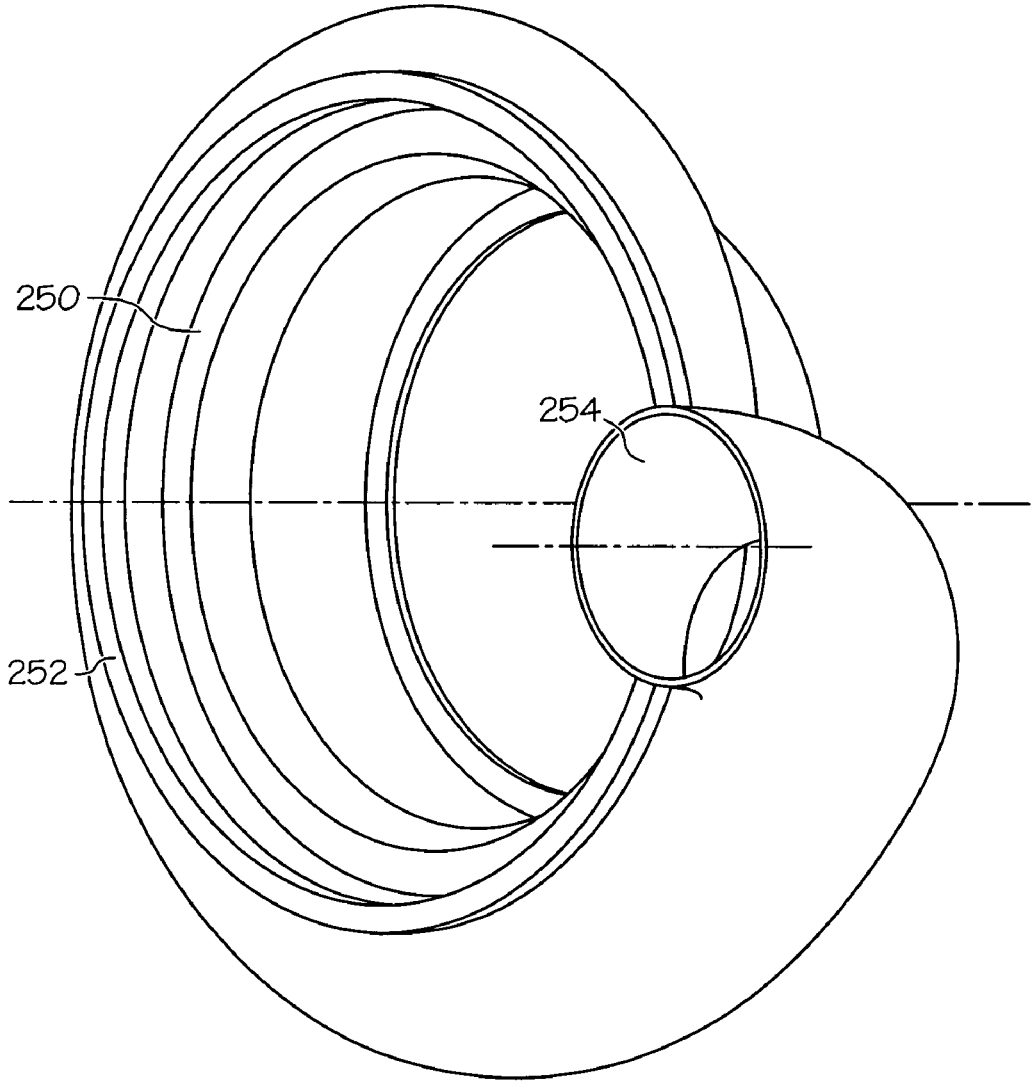
FIG. 2 is an isometric view of an exemplary compressor scroll that may be used in the auxiliary power unit of FIG. 1.

FIG. 2 is an isometric view of the compressor scroll 150 that may be used in the APU 100 discussed in reference to FIG. 1. Although the compressor scroll 150 is discussed herein with reference to the APU 100, it can be used in other types of engines and in any suitable application.

In this embodiment, the compressor scroll 150 has a radial inlet 250 for receiving air from the compressor 124 (FIG. 1). As discussed above, air flows from the radial inlet 250 to an outlet 254. The compressor scroll 150 additionally has a generally spiral shaped body 252 in which the cross-sectional area increases as air flows through the compressor scroll 150 to the outlet 254.

The components of the compressor module 120, including the compressor scroll 150, can be made with any suitable material and manufacturing process. For example, the compressor scroll 150 can be manufactured by machining, brazing, or casting. The compressor scroll 150 can additionally be manufactured in more than one piece and welded or bolted together. However, in one particular embodiment, the compressor scroll 150 is a unitary, integral component, as will be discussed in greater detail below. The compressor module 120 components may be made from titanium, steel, aluminum composites, stainless steel, or other materials.

Figure 3:
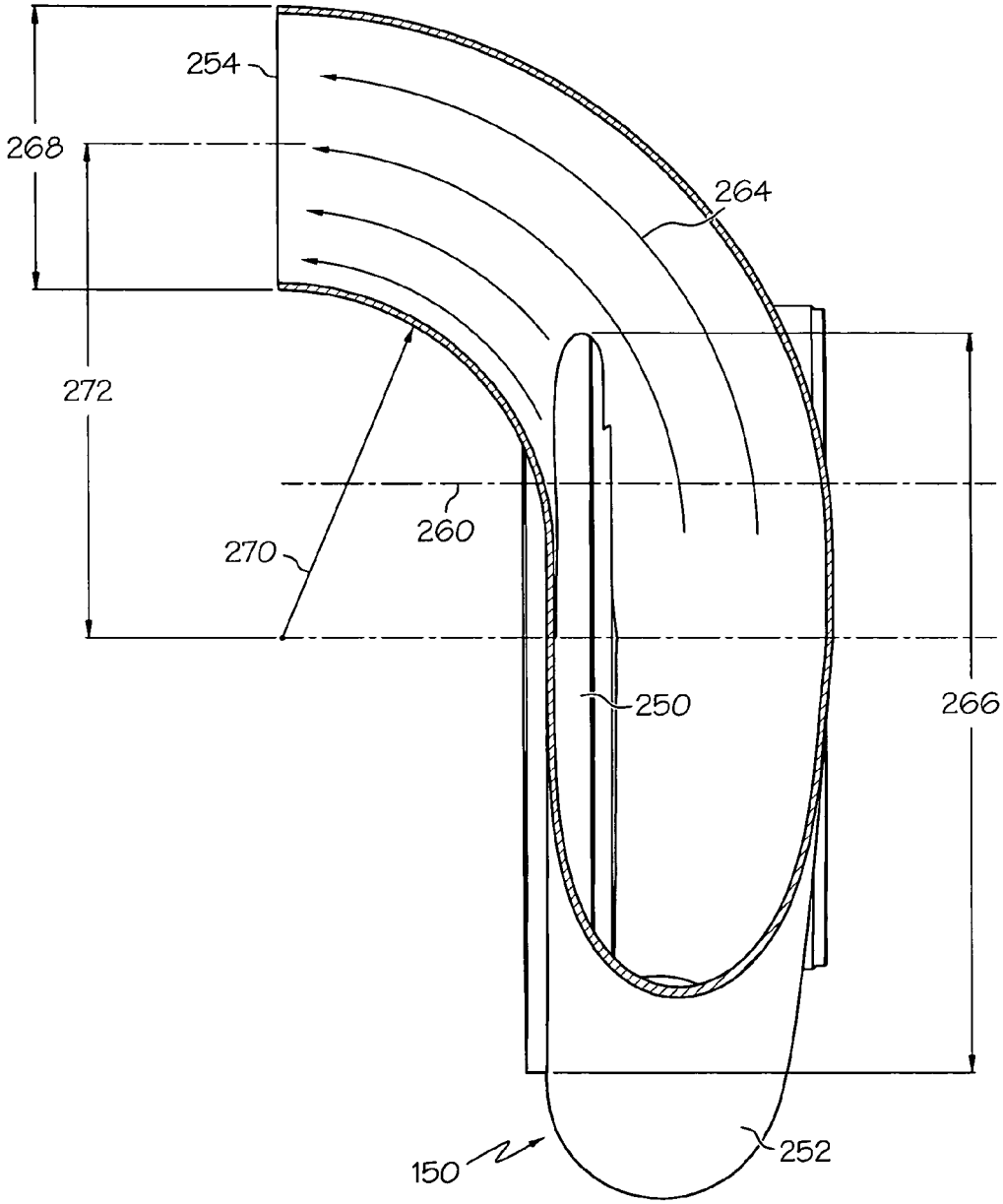
FIG. 3 is a partial, cross-sectional side view of the exemplary compressor scroll of FIG. 2.
Figure 4:
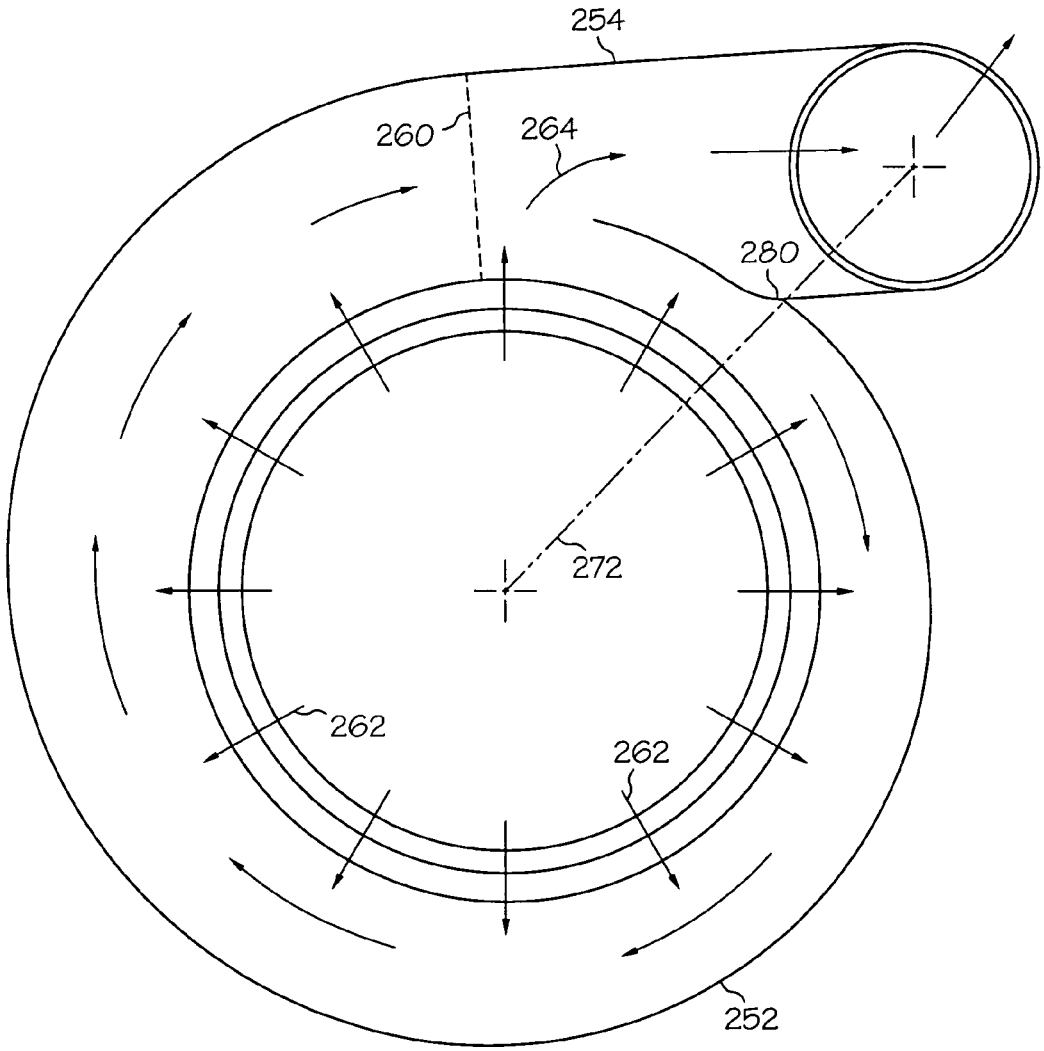
FIG. 4 is a cross-sectional view of the exemplary compressor scroll of FIGS. 2 and 3.

FIG. 3 is a partial, cross-sectional side view of the compressor scroll 150, and FIG. 4 is a cross-sectional view of the compressor scroll 150. FIGS. 3 and 4 will be described together below. As noted above, the compressor scroll 150 has a radial inlet 250 that is configured to be coupled to the compressor 124 (FIG. 1). The compressor scroll 150 has a generally spiral body 252 that spirals into an outlet 254. The outlet 254 is configured to be coupled to a duct for supplying the compressed air to other portions of the aircraft.

Generally, the body 252 of the compressor scroll 150 can spiral in a first plane, which corresponds to the cross-sectional view of FIG. 4 and into the page of FIG. 3. The outlet 254 typically extends outwardly relative to the body 252 in a perpendicular direction to the first plane. Moreover, in this embodiment and for reference in the discussion below, the outlet 254 is considered to begin at the point at which the outlet 254 curves out of the first plane, which is indicated by the dashed line 260 in FIGS. 3 and 4. It is additionally noted that the inlet 250 of the compressor scroll 150 has a radial extent (or diameter) 266 within the first plane. A flow diverter 280 is best shown in FIG. 4 and is the portion of the outlet 254 that joins to the outer circumference of the body 252.

Air from the compressor typically enters the inlet 250 in a radial direction about the scroll centerline. The inlet airflow 262 enters the body 252, spirals through the compressor scroll 150, and exits through the outlet 254 as outlet airflow 264. Generally, the flow diverter 280 is the point at which the air no longer moves radically around the scroll 150, and starts moving tangentially into the subsequent duct. As can most clearly be seen from FIG. 4, at least a portion of the outlet airflow 264 crosses over the inlet airflow 262. The air that is moving tangentially in the outlet 254 is crossing over the air that is still traveling radially into the scroll 150, i.e., a "crossover" flow. In one embodiment, at least a portion of the outlet airflow 264 crosses at least a portion of the inlet airflow 262 at approximately a 90° angle. This phenomenon primarily occurs because the outlet 254 begins curving out of the first plane at line 260 within the radial extent 266 of the inlet 250. In other words, the outlet 254 begins curving out of the first plane at line 260 at an upstream position to the flow diverter 280. Line 260 is also referred to herein as the "coupling point" because it is the point at which the outlet 254 is coupled to the body 252. Generally, the outlet 254 curves at a 90° angle to the first plane to align and attach to aircraft ducting. In contrast, the outlet of a conventional compressor scroll typically begins outside of the radial extent of the inlet and/or downstream of the flow diverter, and as a result, the outlet and/or body of the conventional compressor scroll require at least one elongated or straight, extended portion and an additional bend to align and attach to aircraft ducting.

The outlet 254 has a diameter 268 and a radius of curvature 270, as measured from the center of the compressor scroll 150. In one embodiment, the radius of curvature 270 is less than approximately 1.5 times the diameter 268 of the outlet 254. In one particular embodiment, the radius of curvature 270 is approximately 1.5 times the diameter of the outlet 254. This ratio can provide an advantageous compromise between aerodynamic performance and sizing constraints.

Additionally, the size of the compressor scroll 150 can be reduced relative to prior art scrolls. For example, by starting the outlet 254 in an upstream position relative to prior art scrolls, a radius 272, as measured from the center axis of the compressor scroll 150 to the center axis of the outlet 254 can be reduced. In one embodiment, the radius 272 can be reduced 25%.

As suggested above, in many conventional scrolls, the outlet can have an elongated, straight portion such that the outlet airflow completely clears the inlet airflow prior to exiting the compressor scroll. In these conventional scrolls, there is no interaction between the inlet airflow and the outlet airflow. Accordingly, the more compact compressor scroll 150 discussed herein can have a much smaller diameter for similar aerodynamic requirements. Analyses using computational fluid dynamics (CFD) performed with the compressor scroll 150 such as shown in FIGS. 1-4 have demonstrated that the configurations described herein have at least as satisfactory aerodynamic performance as conventional compressor scrolls. The velocity and the uniformity of the outlet airflow 264 can be maintained while additionally providing a more compact compressor scroll.

As noted above, the outlet 254 of the compressor scroll 150 can be integral with the body 252. In many conventional compressor scrolls, the outlet is formed separately from the body, and is then bolted on. This requires flanges on the body and outlet to accommodate the bolts, which additionally increases the overall width, weight, and installation requirements of the compressor scroll. Moreover, the additional components make it difficult to predict structural behaviors due to thermal and mechanical loading during transient conditions. In one embodiment, the integral nature of the body 252 and outlet 254 is enabled by the body 252 and outlet 254 being configured such that the outlet airflow 264 crosses over the inlet airflow 262, as discussed above.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A compressor scroll for redirecting an airflow from a compressor, comprising:

a spiral-shaped body;

a radial inlet formed in the body for receiving the airflow from the compressor as inlet airflow; and an outlet formed in the body such that inlet airflow flows through the body and exits the outlet as outlet airflow, at least a portion of the outlet airflow crossing at least a portion of the inlet airflow, the outlet being coupled to the body at a coupling point, and wherein outlet includes a flow diverter that couples the outlet to an outer circumference of the body, the flow diverter being positioned downstream relative to the coupling point.

2. The compressor scroll of claim 1, wherein the outlet and the body are integral.

3. The compressor scroll of claim 1, wherein the body spirals in a first plane and the outlet extends perpendicularly to the first plane.

4. The compressor scroll of claim 3, wherein the inlet has a radial extent in the first plane and the outlet extends at least partially out of the first plane within the radial extent.

5. The compressor scroll of claim 3, wherein the outlet has a 90° bend perpendicularly to the first plane.

6. The compressor scroll of claim 1, wherein the outlet has a diameter and a radius of curvature, the radius of curvature being less than about 1.5 times the diameter.

7. The compressor scroll of claim 1, wherein the outlet has a diameter and a radius of curvature, the radius of curvature being about 1.5 times the diameter.

8. The compressor scroll of claim 1, wherein the inlet airflow is radial and the outlet airflow exits tangentially to the inlet airflow.

9. An auxiliary power unit for an aircraft, comprising:

a compressor for receiving and compressing air; and a compressor scroll for receiving the air from the compressor and redirecting the air into a duct for supplying the air to other portions of the aircraft, the compressor scroll comprising an inlet coupled to the compressor and receiving the air as inlet airflow;

an outlet configured to be coupled to, and providing the air to, the duct as outlet airflow; and a spiral-shaped body extending from the inlet to the outlet such that at least a portion of the outlet airflow crosses the inlet airflow, the outlet being coupled to the body at a coupling point, and wherein outlet includes a flow diverter that couples the outlet to an outer circumference of the body, the flow diverter being positioned downstream relative to the coupling point.

10. The auxiliary power unit of claim 9, wherein the outlet and the body are integral.

11. The auxiliary power unit of claim 9, wherein the body spirals in a first plane and the outlet extends perpendicularly to the first plane.

12. The auxiliary power unit of claim 11, wherein the inlet has a radial extent in the first plane and the outlet extends at least partially out of the first plane within the radial extent.

13. The auxiliary power unit of claim 11, wherein the outlet has a 90° bend perpendicularly to the first plane.

14. The auxiliary power unit of claim 9, wherein the outlet has a diameter and a radius of curvature, the radius of curvature being less than about 1.5 times the diameter.

15. The auxiliary power unit of claim 9, wherein the outlet has a diameter and a radius of curvature, the radius of curvature being about 1.5 times the diameter.

16. The auxiliary power unit of claim 9, wherein the inlet airflow is radial and the outlet airflow exits tangentially to the inlet airflow.

17. A compressor scroll for redirecting an airflow from a compressor, comprising:

a spiral-shaped body that spirals in a first plane;

a radial inlet formed in the body for receiving the airflow from the compressor as inlet airflow, the inlet having a radial extent; and an outlet formed in the body such that inlet airflow flows through the body and exits the outlet as outlet airflow, the outlet extending at least partially out of the first plane within the radial extent of the inlet such that at least a portion of the outlet airflow crosses at least a portion of the inlet airflow, wherein the outlet has a diameter and a radius of curvature, the radius of curvature being less than about 1.5 times the diameter, the outlet being coupled to the body at a coupling point, and wherein outlet includes a flow diverter that couples the outlet to an outer circumference of the body, the flow diverter being positioned downstream relative to the coupling point.

* * * * *